United States Patent [19]

Nonomura et al.

[11] Patent Number: 4,873,924

[45] Date of Patent: Oct. 17, 1989

[54] FLAT-BED PRESS AND FLAT-BED PRINTING METHOD

[75] Inventors: Tsutomu Nonomura; Hidetoshi Abe, both of Tokyo, Japan

[73] Assignee: Toyo Ink Manufacturing Co., Ltd., Tokyo, Japan

[21] Appl. No.: 233,656

[22] PCT Filed: Nov. 11, 1987

[86] PCT No.: PCT/JP87/00879

§ 371 Date: Jun. 21, 1988

§ 102(e) Date: Jun. 21, 1988

[87] PCT Pub. No.: WO88/03478

PCT Pub. Date: May 19, 1988

[30] Foreign Application Priority Data

Nov. 12, 1986 [JP] Japan ..... 61-267729
Nov. 20, 1986 [JP] Japan ..... 61-275181
Sep. 17, 1987 [JP] Japan ..... 62-233193

[51] Int. Cl.[4] ..... B41F 3/34

[52] U.S. Cl. ..... 101/146; 101/252; 101/366; 101/425; 101/451

[58] Field of Search ..... 101/146, 279, 251, 366, 101/425, 450.1, 451, 252

[56] References Cited

U.S. PATENT DOCUMENTS 4,555,989 12/1985 Marass et al. ..... 101/424

FOREIGN PATENT DOCUMENTS 20702 6/1975 Japan ..... 101/146
13047 4/1976 Japan .
20884 6/1978 Japan .
30044 8/1978 Japan .
121810 9/1979 Japan ..... 101/366
42654 4/1981 Japan .
92566 6/1983 Japan ..... 101/425
187356 11/1983 Japan .
699516 11/1953 United Kingdom ..... 101/146

*Primary Examiner*—Clifford D. Crowder
*Attorney, Agent, or Firm*—Bucknam and Archer

[57] ABSTRACT

A flat-bed press having a carriage (4) which includes an ink roller (7) and a blanket (5), and which is adapted to be moved on a press body frame (1) provided with an inking unit (3) at at least one end thereof, characterized in that the press body frame (1) is provided therein with a table (10) on which the materials (12) to be printed are placed, a feed head (21) having suckers (22) for retaining thereon a material (12) to be printed, and a transfer means (23) for moving the feed head (21) and carrying the material (12) to be printed which is retained on the suckers (22) to a paper bed (9).

5 Claims, 7 Drawing Sheets

FLAT-BED PRESS AND FLAT-BED PRINTING METHOD

DESCRIPTION

TECHNICAL FIELD

This invention relates to a flat-bed press which is provided in its press body frame with a table on which the materials to be printed are placed, and a feeder for supplying a material to be printed to a paper bed, or, in addition, a delivery adapted to discharge a printed material from the feeder and capable of keeping a plurality of printed materials on itself, and more particularly to a flat-bed press used as a proof press, and a flat-bed press capable of carrying out the multicolor printing and usable not only as a proof press but also as a running-on printing press; and a flat-bed printing method.

BACKGROUND ART

In general, in plate-making and printing operations, before the regular printing called a running-on has been done, a proof printing is done so as to examine a printing plate obtained by a plate-making operation and to obtain a standard printed material for a running-on operation.

Since the proof printing is done for the purpose of examining a standard printed material for a running-on operation, it is desirable that the proof printing be done under the conditions close to those for the running-on. Namely it is preferable that the proof printing be done by using a printing machine for running-on. However, the construction of a printing machine for running-on is not convenient for carrying out an operation for printing a small quantity of materials, such as a proof printing operation. Due to the necessity of operating a printing machine efficiently, the proof printing is done by a proof printing machine, i.e. a proofing press, such as a flat-bed planographic press.

In general, in a flat-bed press, such as a proof press, printing is one by moving a carriage, which includes an ink roller, a dampening roller and a blanket, on a press body frame provided with a plate bed, a paper bed, a dampening unit disposed at one end of the frame, and a swingable roller (rider roller) disposed at the other end of the frame for use in applying ink to an inking unit or an ink roller.

In a proof printing operation or a running-on operation for printing a small quantity of materials, which is carried out by a conventional flat-bed press, such as a proof press, an operator feeds materials to be printed, such as paper piece by piece by hand onto a paper bed, and push the materials, which are thus fed, lightly by the tips of his fingers so as to drive the materials to a front guide or a side guide, i.e., the feeding of the materials is done physically.

When one lot of materials to be printed consists of around 10–20 pieces of paper, they may be fed manually by an operator without much trouble. However, when the number of pieces of paper to be printed is large, it becomes very difficult to feed the paper with a high efficiency in a short period of time.

In a printing operation by a conventional, flat-bed press, such as a proof press, grippers holding the printed material on a paper bed are opened by an operator's foot pedal stepping operation, and the printed material is then taken up by hand. When the operator then removes his foot from the foot pedal, the grippers are closed to complete the paper discharging operation.

This operation temporarily stops the printing process and cause a loss of time.

In a conventional printing machine, the printed material are thus taken out one by one by hand from the paper bed, i.e., by an inefficient method.

When one lot of printed materials consist of around 10–20 pieces of paper, they may be discharged manually by an operator without much trouble. However, when the number of pieces of printed paper is large, it becomes very difficult to discharge the printed paper with a high efficiency in a short period of time.

In a flat-bed press, such as a proof press, the monochromatic printing is generally done. In order to carry out a multicolor printing operation by using this printing machine, the printing is done initially in a first color, and the operation of the printing machine is then stopped, the printing machine being then washed. A printing operation using a second color is thereafter started. As many operations as the number of required colors are repeated to obtain multicolor printed materials.

Therefore, carrying out a multicolor printing operation by a flat-bed press, such as a proof press requires considerable time and labor, and multicolor printed materials cannot be obtained by speedy and simple operations in practice.

It is known that some people have attempted to carry out a multicolor printing operation by using a flat bed press without stopping the machine in the midst of the operation. For example, the printing machine disclosed in Japanese Patent Laid-Open No. 134209/1976 is adapted to carry out a multicolor printing operation by using inking units and plate beds the numbers of which correspond to that of the required colors. Although the multicolor printing may certainly be done by this printing machine, a considerable number of constituent parts of the printing machine are divided into as many groups as the number of the required colors. Therefore, the construction of the printing machine is liable to become complicated. Moreover, when the size of the materials to be printed is large, a printing machine of extremely large dimensions is required. Accordingly, this printing machine may be used suitably for the materials to be printed of a comparatively small area but it is not for the materials to be printed of a large area.

The greater part of the operations including an ink supplying operation in a flat-bed press, such as a proof press is carried out manually. For example, the ink is applied to an ink roller and some other rollers by a manual operation as the ink applied thereto is leveled manually to a uniform thickness. Namely, the supplying of ink, the replenishing of ink and the regulating of the thickness of the layer of ink on the rollers, and so on are done by spreading ink over the rollers by a spatula. This means that the controlling of the feed rate of the ink supplied to the ink roller is done relying upon nothing but the experience of the operator. Therefore, a great deal of skill is required to obtain printed materials of quality stable in terms of the quantity of ink in use, and the operational error readily occurs before the materials are printed with a predetermined quantity of ink. This causes the operation efficiency to lower.

A proof press provided with an inking unit is also known. This inking unit is similar to the inking unit in a printing machine for running-on. Consequently, if an inking unit is installed in a conventional proof press, it is necessary to buy a high-priced inking unit.

An ink supply unit which can be used in a proof press is also known. For example, a device for supplying ink via an ink supply nozzle to an ink duct or an ink roller is known.

There are many flat-bed presses in which the feeding and discharging of materials to be printed are generally done by hand. When a considerable number of materials are printed by such a printing machine, these manual operations are not easy to carry out but they require a great deal of labor. The registering of paper, a material to be printed, during the feeding thereof is also done through a manual operation.

It is, in view of the above points, an object of the present invention to provide a comparatively simple device for carrying out the feeding or, in addition to this, discharging of materials to be printed in a flat-bed press, such as a flat-bed planographic machine utilized generally as a proof press, and thereby solve the above-mentioned problems.

It is another object of the present invention to provide a flat-bed press, such as a flat-bed planographic machine utilized generally as a proof press, or a flat-bed printing method, which is capable of carrying out a multicolor printing operation and obtaining printed materials of a stable quality through an automated printing operation, and which enables even an unskilled operator to obtain printed materials of a stable and uniform quality.

It is still another object of the present invention to provide a flat-bed press or a flat-bed printing method, which is capable of making multicolor printed materials at a higher speed as compared with a conventional flat-bed press.

DISCLOSURE OF INVENTION

This invention provides a flat-bed press having a carriage which includes an ink roller and a blanket, and which is adapted to be moved on a press body frame provided with an inking unit at least one end thereof, characterized in that the press body frame is provided therein with a table on which the materials to be printed are placed, a feed head having one or more suckers for retaining thereon a material to be printed, and a transfer means for moving the paper feed head and carrying the material to be printed which is retained on the suckers to a paper bed.

The present invention further provides a flat-bed press characterized in that the carriage is provided with a delivery board, a delivery head consisting of a printed material retaining sucker, and a sucker retaining delivery arm, and a transfer means for moving the paper discharge head on the delivery board and lowering and returning the paper discharge head from and to the delivery board.

The present invention further provides a flat-bed press, wherein a carriage including an ink roller, a dampening roller and a blanket is moved on a press body frame provided with a plate bed, a paper bed, and a dampening unit and an inking unit which are at both ends of the machine body frame, comprising (a) a table on which the materials to be printed are placed, a feed head having one or more suckers for retaining thereon a material to be printed, and a transfer means for moving the feed head and carrying the material to be printed which is held on the suckers to a paper bed, all of which parts are provided in the press body frame, (b) a means for setting the number of materials to be printed, (c) a blanket washing unit provided in the press body frame and adapted to wash the blanket in the carriage after the completion of each color printing of a designated number of materials, (d) an ink washing unit adapted to wash the ink roller in the carriage and the inking unit in the press body frame, and consisting of a washing oil supply unit provided in the carriage, and a scraping doctor provided in the machine body frame, (e) an ink supply unit having an ink supply roller consisting of an ink distributing roller member and an ink oscillating roller member, and an ink supply means adapted to be moved reciprocatingly along the ink distributing roller member and provided with a plurality of ink discharge nozzles the number of which is in accordance with that of the colors of the ink in use.

The present invention further provides a printing method, wherein a carriage including an ink roller, a dampening roller and a blanket is moved on a press body frame provided with a plate bed, a paper bed, and a dampening unit and an inking unit which are at both ends of the press body frame, comprising the steps of (a) setting the number of the materials to be printed, by a number of materials setting means, (b) printing the set number of materials, moving the carriage to a position above a blanket washing unit provided in the press body frame, and then washing the blanket in the carriage, (c) moving the carriage to a position above the inking unit in the press body frame, and washing the ink roller in the carriage and the inking unit in the press body frame by an ink washing unit consisting of a washing oil supply unit provided in the carriage and a scraping doctor provided in the press body frame, (d) supplying the ink of a predetermined color from an ink supply means which is adapted to be moved reciprocatingly along an ink distributing roller member in an ink supply roller consisting of the ink distributing roller member and an ink oscillating roller member, and which has a plurality of ink discharge nozzles the number of which is in accordance with that of the colors of the ink in use, (e) making preparations for a printing operation as necessary by supplying ink to the inking unit, moving the carriage to a position above the dampening unit, supplying dampening water to a dampening roller, carrying out a dampening water-inuring operation in which the carriage is moved reciprocatingly on a plate bed supplying ink to a plate, bringing the blanket into contact with the plate, and carrying out a trial printing operation for proper registering, and (f) repeating the steps (b)–(d) or the step (e) in accordance with the number of the colors of the ink in use.

BEST MODE FOR CARRYING OUT THE INVENTION

Figure 1:
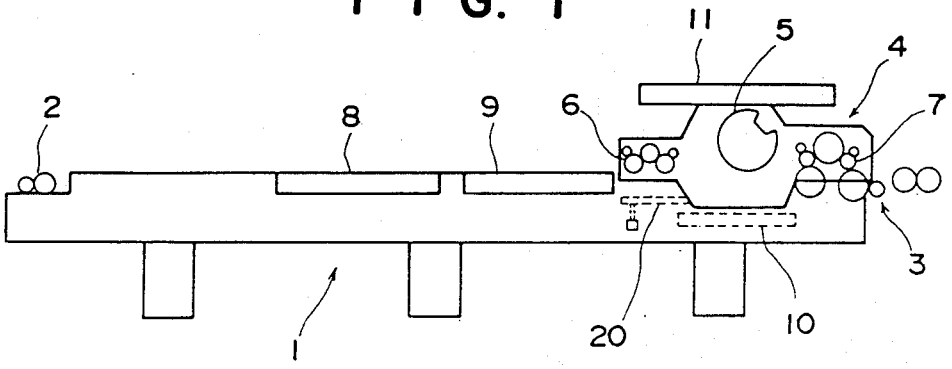
FIG. 1 is a side elevation of an example of the flat-bed press according to the present invention.

FIG. 1 is a side elevation of an example of the flat-bed press according to the present invention. A dampening unit 2 and an inking unit 3 are provided at both ends of a press body frame 1, and a carriage 4 including a blanket (usually, a blanket is provided on a blanket cylinder) 5, a dampening roller (a molten roller) 6 and an ink roller 7 is moved on the press body frame 1. The press body frame 1 is provided therein with a plate bed 8 and a paper bed 9. The press body frame 1 is further provided therein with a table 10 on which the materials to be printed are placed, and a paper feed unit 20. A plate for printing a material is provided on the plate bed 8, and materials to be printed are on the paper bed 9. The carriage 4 is moved reciprocatingly on the machine body frame 1, and the dampening water and ink are applied to the plate, the ink on the surface of the plate being transferred to a material to be printed, via the blanket 5 to carry out a printing operation. Reference numeral 11 denotes a paper discharge board. The press body frame 1 is usually provided with a water board 14 (refer to FIG. 7).

In an aspect of embodiment shown in FIG. 1, a flat-bed press using a dampening unit 2 is employed, and a printing operation is carried out usually by using a PS plate as a printing plate. The present invention can, of course, applies to a case where a resin relief printing is used without using or operating a dampening unit and dampening roller, and a case where the driography is employed. When the multicolor printing is done, the printing plate is usually changed every time the color of the ink is changed.

Figure 2:
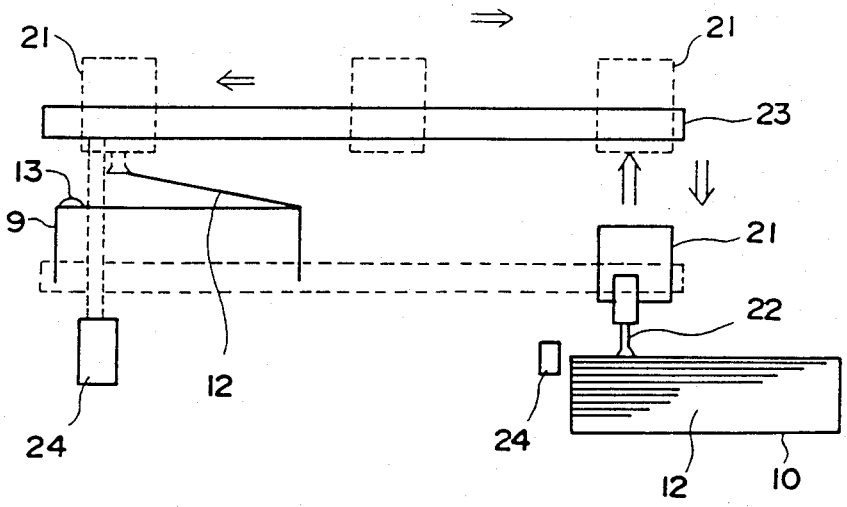
FIGS. 2 and 3 are a side elevation and a plan for use in describing a table on which the materials to be printed are placed, and a feeder in the present invention.
Figure 3:
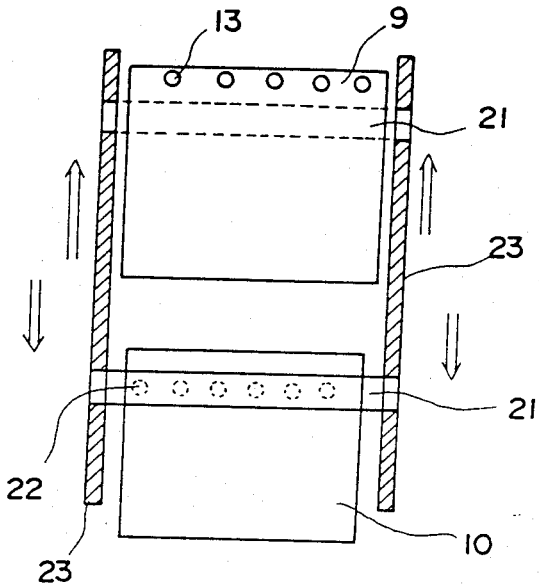
Figure 4:
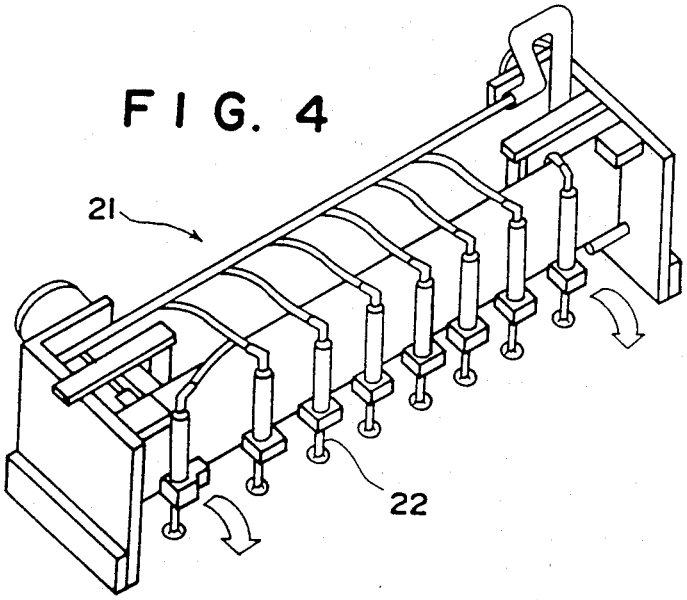
FIG. 4 is a perspective view of a feed head in the present invention.

FIGS. 2 and 3 are a side elevation and a plan for use in describing the table 10 on which the materials to be printed are placed, and the feeder 20 in the present invention. In FIGS. 2 and 3, some parts are shown by broken lines so as to illustrate the condition of movements thereof. FIG. 4 is a perspective view of a feed head 21.

The feeding of paper, i.e. the feeding of the materials 12 to be printed to the paper bed 9 in the present invention will now be described with reference to FIGS. 2-3.

The materials 12 to be printed are placed every lot, each of which consists of a plurality of pieces, on the table 10 in advance. The materials 12 to be printed which are placed on the table 10 are usually separated with the air discharged from an air discharge port 24. While the paper is fed, the discharging of the air from this port 24 is done at all times. Since the air is discharged at the paper-lifting side, which is closer to the paper feed head 21, suckers 22 can take up the materials 12 one by one reliably.

A plurality of suckers 22 are usually provided as shown in FIG. 4. The suckers 22 will now be described as suckers capable of moving down from the feed head 21. These suckers 22 may consist of suckers fixed to the feed head 21.

(1) Let a position, in which the suckers 22 have moved down from the feed head 21 to be ready to suck a material 12 to be printed, be an original point. First, when the suction valves (not shown) for the suckers 22 are turned on in this original position by a signal, the uppermost material 12 alone out of the materials 12 to be printed on the table 10 is sucked.

(2) The feed head 21 having the suckers 22 on which the material 12 is held is moved up vertically by a transfer unit 23.

(3) The feed head 21 is moved in parallel with the rails on the machine body frame 1 toward the paper bed 9, and stopped with the front end of the material 12 in a position (this position can be varied by a numeral marking system) near the grippers 13 provided on the paper setting board 9 and used to fix the material 12.

(4) After the feed head 21 has been stopped as mentioned in (3), the suckers 22 move down from the feed head 21, and the suction valves are turned off, the material 12 being then released and fed onto the paper bed 9.

(5) At the same time that the material is released, the registering of the material is done by a registering means (not shown), and the grippers 13 are then closed to fix the material 12. The suckers 22 then move up.

(6) At the same time that the grippers 13 are closed, the feed head 21 is moved horizontally to the table 10, and it is then moved down perpendicularly to return to the original point.

The above is the procedure of printing one piece of material. The continuous feeding of paper, i.e. the feeding of the second piece of paper onward is done by repeating the steps (1)-(6).

Owing to the machine according to the present invention, the paper is fed automatically, and the operation efficiency is improved. In the present invention, a feeding operation is automated. If a system for automating a paper delivering operation is installed, a more heavily automated printing machine can be obtained. The delivery will now be described.

Figure 5:
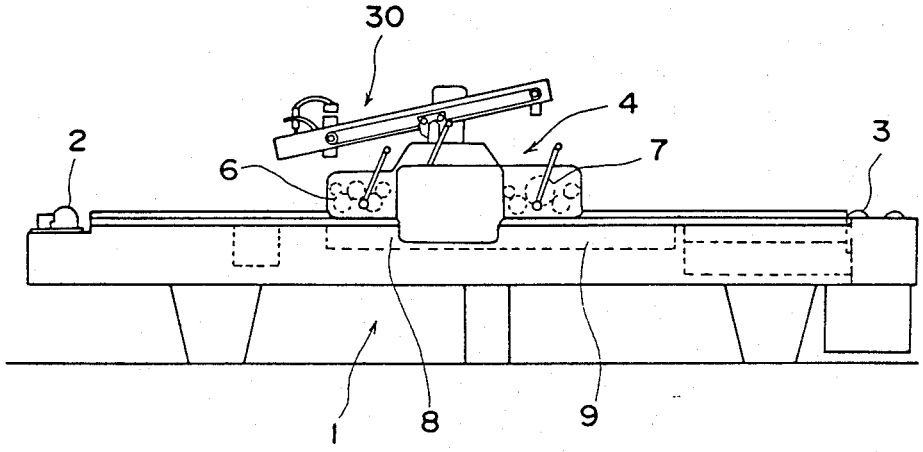
FIG. 5 is a side elevation of an example of a flat-bed press according to the present invention.

FIG. 5 is a side elevation showing the outline of a flat-bed press having a delivery according to the present invention. A plate for printing materials is set on a plate bed 8, and materials to be printed on a paper bed 9. A carriage 4 is then moved reciprocatingly on a press body frame 1 to apply the dampening water and ink to the plate, and the ink on the surface of the plate is transferred to a material to be printed, via a blanket provided in the carriage 4, the printing of the material being thereby carried out. Reference numeral 30 denotes a delivery.

In the aspect of embodiment shown in FIG. 5, a flat-bed press using a dampening unit 2 is employed, and a printing operation is carried out usually by using a PS plate as a printing plate. The present invention can, of course, applies to a case where a resin relief printing is used without using or operating a dampening unit and dampening roller, and a case where the driography is employed. When the multicolor printing is done, the printing plate is usually changed every time the color of the ink is changed.

Figure 6:
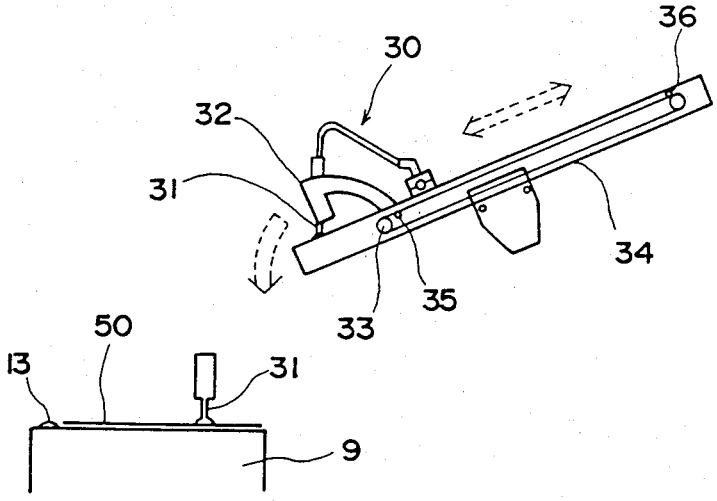
FIG. 6 is a side elevation for use in describing the outline of a paper discharge unit in the present invention.

FIG. 6 is a side elevation for use in describing the outline of the delivery in the present invention. In FIG. 6, arrows are used to express the condition of movements of some parts.

The delivery 30 includes a delivery head consisting of a sucker 31 and a delivery arm 32, a delivery board 34, a transfer unit having a motor 33 and an air cylinder (not shown), and a sensor 35 for detecting the lower limit of the delivery head and a sensor 36 for detecting the upper limit of the delivery head. The sensor 35 for detecting the lower limit of the delivery head and the sensor 36 for detecting the upper limit thereof are not essential.

A delivering operation, i.e. an operation for discharging a printed material 50 from a paper bed 9 in the present invention will now be described.

(1) A carriage is moved on the paper bed 9, on which the material 50 printed by a blanket is placed. At the same time that the carriage passes the paper bed 9, the grippers 13 are opened.

(2) The delivery arm 32 for moving the sucker 31 is lowered from the delivery board 34 by an operation of the air cylinder (not shown), and the sucker 31 is then moved down from the delivery arm 32 to reach a position in which the sucker 31 contacts the printed material 50. A combination of the sucker 31 and delivery arm 32 is called a delivery head.

(3) When a valve (not shown) for the sucker 31 is turned on, the sucking of the printed material is started, i.e., the sucker 31 draws the printed material 50.

(4) Simultaneously with the sucking of the printed material 50, the sucker 31 moves up, and the delivery arm 32 ascends (returns) onto the delivery board 34. In this embodiment, a structure in which the sucker 31 can be moved up or down with respect to the delivery arm 32 is described. The sucker 31 may be fixed to the delivery arm 32.

(5) The delivery head is transferred, i.e., moved up on the delivery board 34 by the motor 33.

(6) When the delivery head is detected by the discharge head upper limit detecting sensor 36, it is stopped, and, at the same time, the valve for the sucker 31 is turned off, so that the printed material 50 is released on the delivery board. The printed material 50 is placed on the delivery board 34 due to the gravity.

(7) At the same time that the valve, for the sucker 31 is turned off, the delivery head moves down, and is then detected by the delivery head lower limit detecting sensor 35 and stopped.

The above is the procedure of discharging one printed material. The continuous discharging of printed materials, i.e. the discharging of a second printed material onward is done by repeating the steps (1)–(7).

Owing to the printing machine according to the present invention, the discharging of printed paper is done automatically, and the operation efficiency is improved. Namely, since the automation of the discharging of printed paper is achieved in addition to the automation of the feeding of paper to be printed, a more heavily automated printing machine can be obtained. If the delivery unit is fixed to the carriage, the discharging of printed paper can be done without occupying a large space.

The flat-bed press according to the present invention will now be described with reference to FIGS. 1–6, with a description of the procedure of a carriage operation included.

The carriage 4 positioned on the side (rear limit) of the inking unit 3 is moved toward the side (front limit) of the dampening unit 2, and the suckers 22 draw a material 12 to be printed thereto simultaneously with this time.

While the carriage 4 is moved toward the front limit, a switch (not shown) provided in the machine body frame 1 is brought down to be turned on, and the paper feed head 21 moves up perpendicularly. During this time, the carriage 4 is, of course, in a position closer to the dampening unit 2 than to the paper feed head 21.

By the time the carriage 4 has reached the dampening unit 2, the feed head 21 is moved onto the paper bed 9, and the material 12 to be printed is released, the registering of the material 12 being then carried out.

When the registering of the material 12 to be printed has been completed, the grippers 13 are closed, and the material 12 is fixed to the paper bed 9. When the grippers 13 are closed, a signal is sent out, and the carriage 4 is moved toward the inking unit 3.

The carriage 4 passes the material 12 on the paper bed 9 to thereby carry out the printing thereof.

Operation timing of each element is determined, such that simultaneously with the movement of the carriage 4 toward the inking unit 3, the paper feed head 21 is also moved toward the inking unit 3 and in the downward direction thereby avoiding the interference against the passage of the carriage 4.

The feed head 21 is moved up and down by the transfer unit 23.

Immediately after the carriage 4 has performed printing, the grippers 13 are opened by the switch (not shown) provided in the press body frame 1, so that the printed material 50 is released therefrom.

The delivery head is moved down by an operation of a switch (not shown) provided immediately behind the switch for opening the grippers 13, to suck and retain the printed material 50.

The carriage 4 is moved to the rear limit, and the printed material 50 is placed on the delivery board 34 in the delivery 30 provided on the carriage 4.

The printing using a flat-bed press is done by taking the sequential steps of setting the dampening water and ink ready to be used, going through a warm-up in which the ink and dampening water are supplied to a printing plate, and carrying out the printing of the material. In the printing step, the number of the materials to be printed is set, and the printing of the materials is done on receiving an instruction for starting the printing.

Figure 7:
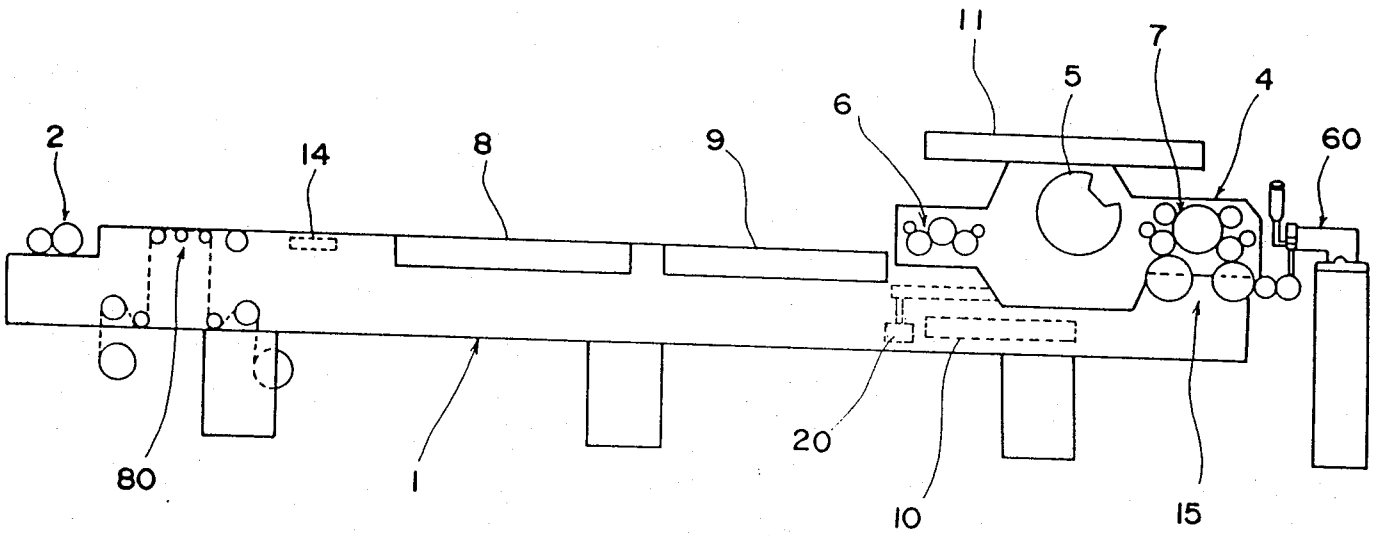
FIG. 7 is a side elevation of an example of an automated flat-bed press according to the present invention.

An example of the automated flat-bed press according to the present invention is shown in side elevation in FIG. 7.

The operation of the automated flat-bed press consists roughly of (1) setting the dampening water and ink ready to be used, (2) going through a warm-up, (3) carrying out the printing, (4) washing the blanket, (5) washing the ink, (6) exchanging the ink, and (7) repeating the steps (2)–(6). The steps (4) washing the blanket, and (5) washing the ink are reversed in some cases. The steps (1) setting the dampening water and ink, and (2) going through a warm-up are also taken in a conventional flat-bed press.

The step (1) includes an operation for setting dampening water ready to be used and an operation for setting ink ready to be used. This step is usually taken only once even when the multicolor printing is done.

(1)-1 (dampening water): Before the printing machine is started, the supply of dampening water is initiated. The dampening water is supplied to the dampening roller 6 as the temperature and humidity of the printing room and the temperature of the dampening water are detected to vary a setting timer arbitrarily. The carriage 4 is fixed at the front limit (dampening side) of the printer while the dampening water is supplied. After the supplying of the dampening water for a set period of time has been completed, the rollers, such as the dampening roller 6, on the side of the carriage is put in a disengaged state by the air cylinder, so that the dampening roller is rotated idly.

Figure 9:
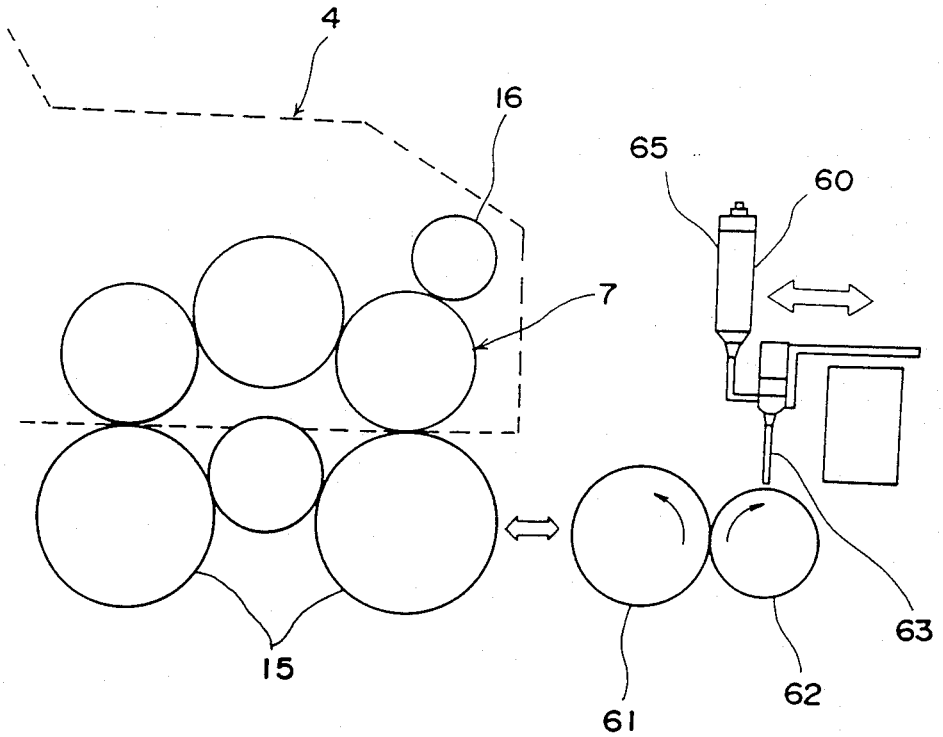
FIG. 9 is a side elevation for use in describing an operation for drawing the ink from an ink supply unit to an ink roller in the present invention.
Figure 10:
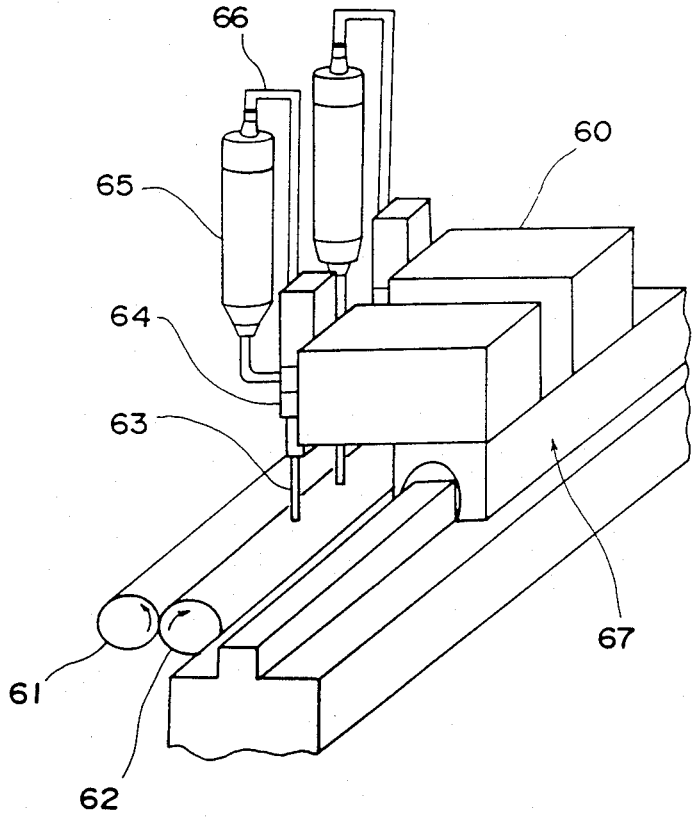
FIG. 10 is a partial perspective view of the ink supply unit in the present invention.

FIG. 9 is a side elevation illustrating an operation for drawing ink from the ink supply unit to the ink roller. FIG. 10 is a partial perspective view of the ink supply unit. In FIG. 10, means for supplying two colors of ink are shown as examples. A means for supplying four or other number of colors of ink may, of course, be provided.

(1)-2 (ink): The carriage 4 is fixed at the rear limit of the printing machine (Position on the side of the inking unit). A color of ink is selectively determined, and a selector button switch is turned on, so that an ink discharge nozzle 63, a pressure valve 64 and an ink container 65 are moved forward to a position above the axis of an ink distributing roller 62 and locked. The ink supply means consisting of the ink discharge nozzle 63, pressure valve 64 and ink container 65 does not discharge ink of different colors at a time.

The ink supply unit 60 shown in FIG. 10 consists of an ink supply means composed of an ink discharge nozzle 63, a pressure valve 64, an ink container 65 and an air tube 66, a transfer unit 67, and an ink supply roller composed of an ink distributing roller member 62 and an ink oscillating roller member 61. If a pressure of a constant level is applied from the air tube 66 to the ink distributing roller member 62, which is not in motion, from the driving side, i.e. B side of the printing machine to A side, the ink supply means is moved at a variable speed along the transfer unit 67 as the ink is discharged at a predetermined rate from the ink discharge nozzle 63. The variable-speed movement of the ink supply means is made in accordance with an arbitrary number of divisions of an object picture, i.e., the ink discharge nozzle is moved at an arbitrary speed set in accordance with the area of the image portion of each division. Namely, the moving speed of the ink discharge nozzle 63 may be increased at a point above a division having a small area of a picture portion, and reduced above a division having a large area of a picture portion. The reasons why the ink discharge nozzle 63 is moved in this manner reside in that the quantity of the ink discharged from the ink discharge nozzle 63 is determined depending upon the ink discharge time since the ink discharge pressure is kept constant.

The ink distributing roller member 62 and ink oscillating roller member 61 are paired in an engaged state with respect to oscillating rollers 15 on the side of the press body by an operation of a timer, which can be set arbitrarily, and the engagement and disengagement transferring actions are made. The ink is then supplied to the ink roller 7, and the number of transferring actions can be set arbitrarily. A transferring action made by the ink supply unit 60 with respect to the ink roller 7 on the side of the press body is shown in side elevation in FIG. 9. The drawing shows the ink roller 7 and an ink leveling roller 16.

After the set number of calling actions are completed, the calling action is stopped, to finish making preparations for supplying ink.

The number of the ink rollers in the automatic ink dividing unit is not limited to only that of the ink rollers employed in the embodiment. It is, of course, possible to increase the number of rollers for the purpose of improving the ink-distribution effect.

The ink supply unit shown in FIG. 10 consists of a comparatively simple structure, and practically forms a film of ink on a roller in accordance with the area of an image. Moreover, the printing can be done without causing the ink to be deposited on the operator's hand, so that his ink supply unit has a satisfactorily good antifouling effect which has heretofore been strongly demanded.

If a heat insulating material is wound around the ink discharge nozzle 63, pressure valve 64 ink container 65, and so on, the ink can be supplied smoothly even in a cold district.

The warming-up in the step (2) will now be described. In the warming-up, the ink and dampening water are supplied to the plate after the completion of the preparation operation.

(2)-1 (dampening water): The dampening roller 6 alone is engaged, and the dampening water is supplied onto the surface of the plate arbitrary number of times. After the dampening water has been supplied a set number of times, the carriage 4 is stopped at the rear limit.

(2)-2 (ink): After the supplying of the dampening water has been completed, the dampening roller 6 and ink roller 7 are engaged, and the ink is supplied to the plate provided on the plate bed 8. After the ink has been supplied a set number of times, the carriage 4 is stopped at the rear limit.

(2)-3 (blanket): After the supplying of the ink has been completed, the dampening roller 6, ink roller 7, and blanket 5 provided on the blanket cylinder are engaged, and image areas are formed on the blanket in accordance with the arbitrarily set number of times. After the image areas are formed a set number of times, the carriage 4 is stopped at the rear limit.

During the warming-up, the carriage 4 is usually moved reciprocatingly 10–20 times.

The printing in the step (3) will now be described. After the warming-up in the step (2) has been completed, the number of the materials to be printed is set arbitrarily and inputted. During this time (while the number of the materials to be printed is inputted), a stand-by operation can be carried out with the carriage 4 stopped at the front limit as necessary. During the stand-by operation, the carriage 4 is moved from the rear limit to the front limit, and the engagement and disengagement of the dampening roller 6 is repeated at the front limit by an arbitrary timer control operation to stabilize the dampening water on the dampening roller 6.

(3)-1: After the number of materials to be printed has been set, the operating button switch is turned on to feed the materials from the feeder 20 and print the material on the paper bed 9. A first printed material is taken out by stepping on a foot pedal, and judged whether the quality thereof is acceptable or not. Namely, the first printed material is not discharged automatically even in the case where an automatic delivery is provided.

The printing of a second sheet of material onward is done in accordance with the following step (3)-2 or (3)-3.

(3)-2 (printing a second sheet of material onward without carrying out a material registering operation, i.e., printing such materials with ink of a first color): The operating button switch is turned on, and the remaining set number of sheets of materials are printed. The feeding and discharging of the materials to be printed and printed materials are preferably done as follows. After the carriage 4 has been moved toward the front limit and passed the feeder 20, the materials to be printed are fed automatically, and, just after the carriage 4 has been moved toward the rear limit and passed the paper bed 9, the printed materials are discharged automatically.

(3)-3 (printing a second sheet of material onward with a material registering operation carried out, i.e., printing such materials with ink of a second color onward): A misregistering of the first printed material from a proper position is inputted into an automatic registering unit, and a registering button switch is turned on to carrying out a registering operation again. This operation is carried out until the material has been registered properly. After the registering has been done, the operating button switch is turned on to print the remaining set number of sheets of materials.

(4) The washing of the blanket 5 is done by a blanket washing unit 80 provided in the press body frame 1. This blanket washing unit 80 is not specially limited as long as it consists of a known blanket washing unit which can be installed in this printing machine. For example, a blanket washing unit using a brush, and a blanket washing unit using clothes may be used. The carriage 4 is moved to front limit and locked so that the carriage is not moved.

Figure 8:
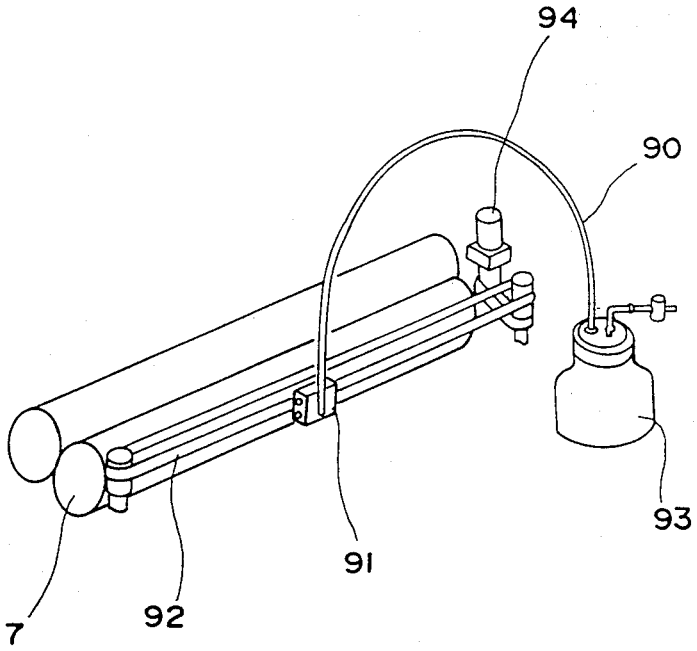
FIG. 8 is a perspective view of an ink washing unit in the present invention.

(5) The ink washing operation is carried out as follows. The carriage is unlocked and stopped at the rear limit, and the ink roller 7 in the carriage 4 and the inking unit in the press body frame 1, i.e. the transferring roller and oscillating roller 15 are washed by the ink washing unit. FIG. 8 is a perspective view showing an example of the ink washing unit.

An ink washing unit 90 shown in FIG. 8 consists of an oil supply member 91, a moving belt 92, an oil tank 93 and a motor 94. The oil supply member 91 consists usually of a sprayer, and is adapted to be moved along the moving belt 92 as it sprays the oil onto the rotating ink roller and the rotating rollers in the press body frame from the printing machine operating side, i.e. A side to B side. In accordance with an operation of a timer set arbitrarily in advance, the doctor is engaged with the oscillating roller 15 by an operation of the air cylinder. The ink is scraped off by this doctor.

(6) The replacement of the ink is carried out as follows. After the doctor in the ink washing unit 90 has been disengaged from the oscillating roller 15, the color of the ink to be used subsequently is selected, and the selector button switch is pressed, so that the ink unit is moved and then locked at the ink container storing the ink of designated color.

In accordance with an operation of a timer which can be set arbitrarily, the ink is supplied from the newly-set ink unit to the printing machine body via the transferring roller. After the set number of calling actions have been done, the calling action is stopped.

This ink replacing operation is also carried out in some cases before the printing of materials with ink of a first color has been completed.

(7) The repeating of the steps usually starts with the step (2) above to carry out the printing of the materials with ink of a subsequent color.

The above is a description of an example of an operation using the flat-bed planographical machine according to the present invention. In the above statement, each action is described separately. In view of the necessity of the automating a printing operation, it is preferable that the whole of a printing operation except an inspection operation be automated to enable each action in the printing of materials to be made without being helped by a person. Namely, it is preferable that an automated printing machine be used, with which, if a desired printing procedure is set at the beginning by an operating button switch, no manual operation except for an inspection operation is required in the intermediate steps.

The flat-bed planographic machine according to the present invention is effective for, especially, multicolor printing, but can, of course, be applied to monochromatic printing.

The flat-bed press according to the present invention is used not only for proof printing but for running-on printing, and capable of printing a small number of sheets, for example, not more than 500 sheets of materials.

Industrial Applicability

In the flat-bed press according to the present invention, around 500 sheets of materials can be fed continuously, i.e., the feeding of the materials to be printed is done without stopping the printing machine, so that the printing speed is improved greatly.

Moreover, since the discharging of printed materials is done without stopping the printing machine, the discharging speed is improved greatly. Since the delivery is provided on the carriage, the flat-bed press does not substantially occupy an excessive space, and printed paper can be discharged automatically by a simple discharge unit.

The present invention is capable of not only improving the printing speed about 1.5 times that in the case where the four-color printing is done by a conventional proofing printing machine, but also providing printed materials of a stable quality. Moreover, the present invention enables the printing to be done without relying upon a skilled hand.

Furthermore, the flat-bed press according to the present invention can be used as a proof press, of course, and also as a printing machine for the running-on of a comparatively small number of sheets of materials.

What is claimed is:

1. A flat-bed press wherein a carriage including an ink roller, a dampening roller and a blanket is moved on a press body frame provided with a plate bed, a paper bed, and a dampening unit and an inking unit which are at both ends of said press body frame, comprising (a) a table on which the materials to be printed are placed, a feed head having one or more suckers for retaining thereon a material to be printed, and a transfer means for moving said feed head and carrying said material to be printed which is held on said suckers to a paper bed, all of which parts are provided in said press body frame, (b) a means for setting the number of materials to be printed, (c) a blanket washing unit provided in said press body frame and adapted to wash said blanket in said carriage after the completion of each color printing of a designated number of materials, (d) an ink washing unit adapted to wash said ink roller in said carriage and said inking unit in said press body frame, and consisting of a washing oil supply unit provided in said carriage, and a scraping doctor provided in said press body frame, (e) an ink supply unit having an ink supply roller consisting of an ink distributing roller member and an ink oscillating roller member, and an ink supply means adapted to be moved reciprocatingly along said ink distributing roller member and provided with a plurality of ink discharge nozzles the number of which is in accordance with that of the colors of the ink in use.

2. A flat-bed press according to claim 1, wherein said ink supply means has a means for transferring said ink discharge nozzles reciprocatingly at variable speeds, which transfer means is capable of regulating an ink discharge rate in accordance with the area of an image.

3. A flat-bed press according to claim 1, wherein said carriage is provided with a paper bed, a delivery head consisting of a printed material retaining sucker, and a sucker retaining delivery arm, and a transfer means for moving said delivery head on said delivery board and lowering and returning said delivery head from and to said delivery board.

4. A flat-bed printing method, wherein a carriage including an ink roller, a water roller and a blanket is moved on a press body frame provided with a plate bed, a paper bed, and a dampening unit and an inking unit which are at both ends of said press body frame, comprising the steps of (a) setting the number of the materials to be printed, by a number of materials setting means, (b) printing the set number of materials, moving said carriage to a position above a blanket washing unit provided in said press body frame, and then washing said blanket in said carriage, (c) moving said carriage to a position above said inking unit in said press body frame, and washing said ink roller in said carriage and said inking unit in said press body frame by an ink washing unit consisting of a washing oil supply unit provided in said carriage and a scraping doctor provided in said press body frame, (d) supplying the ink of a predetermined color from an ink supply means which is adapted to be moved reciprocatingly along an ink distributing roller member in an ink supply roller consisting of said ink distributing roller member and an ink oscillating roller member, and which has a plurality of ink discharge nozzles the number of which is in accordance with that of the colors of the ink in use, (e) making preparations for a printing operation as necessary by supplying ink to said inking unit, moving said carriage to a position above said dampening unit, supplying water to said dampening roller, carrying out a dampening water-inuring operation in which said carriage is moved reciprocatingly on said plate bed, supplying ink to a plate, bringing said blanket into contact with said plate, and carrying out a trial printing operation and proper registering, and (f) repeating said steps (b)–(d) or said step (e) in accordance with the number of the colors of the ink in use.

5. A flat-bed press wherein a carriage including an ink roller, a dampening roller and a blanket is moved on a press body frame provided with a plate bed, a paper bed, and a dampening unit and an inking unit which are at both ends of said press body frame, comprising (a) a table on which the materials to be printed are placed, a feed head having one or more suckers for retaining thereon a material to be printed, and a transfer means for moving said feed head and carrying said material to be printed which is held on said suckers to a paper bed, all of which parts are provided in said press body frame, (b) a means for setting the number of materials to be printed, (c) a blanket washing unit provided in said press body frame and adapted to wash said blanket in said carriage after the completion of each color printing of a designated number of materials, (d) an ink washing unit adapted to wash said ink roller in said carriage and said inking unit in said press body frame, and consisting of a washing oil supply unit provided in said carriage, and a scraping doctor provided in said press body frame, (e) an ink supply unit having an ink supply roller consisting of an ink distributing roller member and an ink oscillating roller member, and an ink supply means adapted to be moved reciprocatingly along said ink distributing roller member and provided with a plurality of ink discharge nozzles the number of which is in accordance with that of the colors of the ink in use, wherein said ink supply means has a means for transferring said ink discharge nozzles reciprocatingly at variable speeds, which transfer means is capable of regulating an ink discharge rate in accordance with the area of an image and wherein said carriage is provided with a paper bed, a delivery head consisting of a printed material retaining sucker, and a sucker retaining delivery arm, and a transfer means for moving said delivery head on said delivery board and lowering and returning said delivery head from and to said delivery board.

* * * * *